United States Patent [19]

Preisler et al.

[11] Patent Number: 4,818,354

[45] Date of Patent: Apr. 4, 1989

[54] PROCESS FOR THE PREPARATION ELECTROLYTIC MANGANESE DIOXIDE

[75] Inventors: Eberhard Preisler, Erftstadt; Johannes Holzem; Gerhard Mietens, both of Hürth; Gerhard Nolte, Erftstadt, all of Fed. Rep. of Germany

[73] Assignee: Hoechst Aktiengesellschaft, Frankfurt am Main, Fed. Rep. of Germany

[21] Appl. No.: 151,882

[22] Filed: Feb. 3, 1988

[30] Foreign Application Priority Data

Feb. 6, 1987 [DE] Fed. Rep. of Germany ..... 3703616

[51] Int. Cl.[4] ..... C25B 1/00

[52] U.S. Cl. ..... 204/96

[58] Field of Search ..... 204/83, 96; 423/605

[56] References Cited

U.S. PATENT DOCUMENTS

| | | | |
|---|---|---|---|
| 3,065,155 | 11/1962 | Welsh | 204/83 |
| 3,780,158 | 12/1973 | Welsh | 423/605 X |
| 4,048,028 | 9/1977 | Moeglich | 204/96 X |
| 4,405,419 | 9/1983 | Misawa et al. | 204/96 |
| 4,474,653 | 10/1984 | Beer et al. | 204/96 |
| 4,549,943 | 10/1985 | Mellors | 204/96 |

*Primary Examiner*—Donald R. Valentine

[57] ABSTRACT

The present invention relates to a method for the preparation of electrolytic manganese dioxide in which flocculent nuclei of a manganese oxide hydrate is dispersed in the electrolyte.

8 Claims, No Drawings

PROCESS FOR THE PREPARATION ELECTROLYTIC MANGANESE DIOXIDE

The invention relates to a process for the preparation of manganese dioxide electrolytically (EMD) by means of titanium anodes in a cell which contains a sulfuric acid solution of manganese sulfate as an electrolyte whose manganese sulfate and sulfuric acid concentrations are kept constant by continuously removing a part by volume of the used electrolyte and replacing it by supplying an equivalent volume of fresh manganese sulfate solution.

In modern electrolysis processes, EMD is deposited on graphite or titanium anodes, titanium anodes having the advantage that they can be used for many years, whereas the service life of graphite depends on its quality and in general is only about 1 year. Titanium anodes tend, however, to develop an oxide layer on their surface which impedes the passage of current. As is generally known, this layer is extensively formed in manganese-free aqueous solutions even at very low current densities ($<1$ A.m$^{-2}$), whereas it is retarded in manganese-containing electrolytes if the electrolysis conditions permit the formation of a coherent compact manganese oxide layer. This is the case at high temperatures, low sulfuric acid concentrations and relatively low current densities (cf. ChemieIngenieur-Technik, 49, 347 (1977)).

At higher current densities and temperatures $<95°$ C., however, the tendency to develop a passive layer at the titanium/manganese dioxide phase boundary increases, for which reason electrolysis at constant current can then be continued only with increased and constantly rising terminal voltage.

Temperature, current density and sulfuric acid concentration have a particularly severe effect if they cause the formation of imperfect deposits of manganese dioxide. Because of internal stresses, the EMD coating on the anode cracks open at various points and makes it possible for the electrolyte to penetrate the titanium-/EMD phase boundary, to generate oxygen at that point and, consequently, to intensify the growth of a $TiO_2$ layer. For this reason, the phenomenon of crack formations, break-up and lifting of lumps from the titanium anode surface is particularly undesirable, especially as experience teaches that a manganese dioxide sludge which has the $\beta$-$MnO_2$ structure and is unsuitable for use in high-power primary cells is formed at such imperfections.

Furthermore, exfoliations and breakups are also undesirable because exfoliated lumps often remain suspended between anode and cathode and make it difficult to extract the anodes at the end of the electrolysis period and often cause damage to the cathodes. In addition, all the material which has dropped off the anode can no longer be used in the manufacturing process for EMD since it no longer meets the purity requirements which are very high.

For the purpose of a trouble-free operation, there is therefore a considerable need for good, imperfection-free EMD coatings on the anodes, it being necessary to bear the economy of any measures in mind.

Obvious measures such as an increase in the temperature of the electrolyte or a reduction in the current density and/or the sulfuric acid concentration have natural (boiling point of the electrolyte) or technical (increased volume to be regenerated with lower sulfuric acid concentration) or economic limits (uneconomic nature of a plant with reduction in the production output).

From this point of view, an observation made earlier acquired a considerable importance when it was possible for an explanation to be found for a phenomenon that had already been known for a long time.

The usual EMD deposits have in general a thickness of 1–1.5 cm, have a smooth surface and exhibit a glass-like fracture. When such a layer is struck, it readily shatters into many irregular parts. By X-ray photography it is found that they consist of $\epsilon$-$MnO_2$, a modification such as has been described by de Wolff, Visser, Giovanoli and Brutsch (Chimia 32, 257/259 (1978)). In laboratory cells having small dimensions, this is the form of deposit which tends to form the imperfections described above to a considerable degree.

On industrial anodes of larger format, yet another form of deposit is often found which we designate REMD because it has a rough surface structure reminiscent of a rasp. It forms mostly in the lower quarter of an anode and extends also somewhat higher upwards at the edges. In total it is possible to estimate that, with variations from electrolysis to electrolysis, approximately 1/5 to ¼ of an anode may be covered with REMD, and this also depends on the size of the anode.

In its properties REMD additionally exhibits important differences from conventional EMD:

1. Break-ups with the formation of sludge never occur,
2. exfoliations never occur,
3. REMD does not have a glassy by a grainy fracture,
4. REMD does not shatter so readily when struck with a hammer, the material being very much more resistant to fracture.

Since, from the battery technology point of view, the suitability of REMD in alkaline manganese cells was essentially equivalent to that of the glass-like EMD, it was possible that a solution to the abovementioned difficulties was to produce the REMD form not only on a part of the anode but on the entire anode surface.

A manganese dioxide electrolysis process is already known in which particles of a manganese compound are added to the electrolyte (Japan Metals & Chemicals Corp., DE-A3,046,913 U.S. Pat. No. 4,405,419 to Mesawa et al). In a manner which has not yet been elucidated, this has the effect that the current density can be increased during the electrolysis. According to this known procedure, manganese dioxide particles, which must, however, be specially ground in order to obtain a fineness of less than 44 $\mu$m particular diameter, are added to the electrolyte. Even then, these solid pulverulent particles, which are added to the electrolyte in the form of a sludge, still have a strong tendency to sediment and distribute themselves in the depth direction of an electrolysis cell with a pronounced gradient. In order to obtain particles of a suitable size, the ground oxides of manganese are suspended in electrolyte, after a short residence time the still floating particles are transferred to the cell and the sedimented particles are again subjected to a wet grinding in an aluminum oxide mill. An additional treatment with ultrasound is claimed to improve the floating capacity.

Attempts to produce a deposit of REMD by this known method on the entire anode surface of an industrial cell were a failure. In this case, finely ground electrolytic manganese dioxide (particle size $<30$ $\mu$m, mean diameter approximately 15 $\mu$m) were used as suspended particles and about 0.3 g/L $MnO_2$ was fed in, which is equivalent to a quantity of approximately 200 mg/L $Mn^{4+}$. This measure proved, however, unsuitable for producing the REMD type with a rough surface on a larger fraction of the anode surface.

On the other hand, it was found, surprisingly, that the desired objective can readily be achieved by producing flocculent nuclei of a manganese oxide hydrate and supplying these nuclei together with said manganese sulfate solution to the electrolyte in the cell.

For example, the nuclei can be produced if sodium hydroxide solution is added to the manganese sulfate solution in a quantity such that manganese hydroxide is formed, this being the case at pH values of at least 7.8.

If oxygen or air, in particular in finely divided form, is subsequently, or preferably, simultaneously with the addition of the sodium hydroxide solution, introduced into the manganese sulfate solution, more highly oxidized manganese oxide hydrates, for example $Mn_3O_4.nH_2O$ or $MnO_2H_m.nH_2O$ (with $m<1$) are produced by oxidation from the manganese hydroxide flakes.

Other methods of nucleus formation are to add an oxidizing agent such as sodium hypochlorite alone or hydrogen peroxide with an equivalent quantity of sodium hydroxide solution to the manganese sulfate solution, in which case flakes of the manganese oxide hydrate $MnO_x.nH_2O$ (with $x\sim1.8$–$1.9$ and $n<1$) are produced.

It is advisable to supply the manganese sulfate solution which contains the manganese oxide hydrate nuclei to the electrolyte in the cell in a quantity such that a nuclei concentration of 10–200 mg/L, preferably of 30–60 mg/L, is established in the electrolyte. The nuclei concentration is determined analytically by taking liquid samples at numerous points in the electrolyte tank and examining them for their content of tetravalent manganese which is, of course, produced by the presence of nucleating agents because the latter contain manganese in a higher than divalent form. The analytical determination was carried out by reacting a sample of solution with a known quantity of arsenous acid, the excess of arsenous acid being back-titrated with a standard Ce(IV) sulfate solution (this method is generally known for the determination of "active oxygen" in manganese dioxide and other manganese oxides).

The use of the nucleating agents cited is particularly advantageous because they distribute themselves very uniformly in the electrolysis bath without any measures being necessary for the comminution of the nuclei or returning unsuitable material.

A precise examination of the REMD deposit led to the surprising result that, in addition to the coarsely rough surface, there is also a fine roughness which is formed from small dendrites situated close together. The coarsely rough structure suggested the idea that the flow in the electrolysis cell, which is mainly caused by the cathodic generation of hydrogen must play a part in the production of the REMD. The fine roughness might therefore be initiated by nuclei of crystallization which drift in through the electrolyte and are adsorbed at the surface.

The effective, electrochemically active surface may consequently be larger than the geometrical surface of the anode by at least an order of magnitude. From this it follows that the effective current density is also smaller by about an order of magnitude than the theoretical current density of the REMD deposit. (In technical data, the latter is always specified.) Consequently, an REMD is an EMD with a very low deposition current density of $i_{eff}<0.1$–$0.2$ A.dm$^2$ with an $i_{theor.}$ of approximately 1.5 A.dm$^{-2}$, the direction of growth, however, being subject to an extremely severe variation if the form of the spiky formations is considered, and which leads to an effective keying of the $MnO_2$ crystallites. The electrical resistance of an REMD with a deposition current density of $i_{theor.}=1.5$ A./dm$^{-2}$ is 6–10 ohm.cm, that of an EMD with the same deposition density is 100–150 ohm.cm, whereas in the case of an EMD ($i_{theor.}=i_{act}$) a resistance of 6–10 ohm.cm can only be achieved with a deposition current density of 0.05–1.10 A.dm$^2$.

A similar relationship can be found between current density and specific surface (BET nitrogen adsorption method).

With adsorption of the nucleating agents on the electrode surface (this takes place not only on the titanium metal base but on the surface of the electrolytic manganese dioxide at every instant during the electrolysis), the spike or dendrite growth states, and is repeatedly interrupted and started again. This concept of nuclei formation also explains why coarse particles are less effective even if they should be in contact with the anode surface. Their number is much smaller per unit of mass than is the case for the nucleating agents according to the invention and the probability of a successful adsorption is much smaller.

The invention will be explained by reference to a few examples.

EXAMPLE 1

(Preparation of EMD in good quality)

2 graphite plates measuring 20×40×2 cm were disposed as cathodes at the side walls 2 in a trough-shaped electrolysis cell having the dimensions 70×50—15 cm and a plate consisting of titanium sheet measuring 11×40×0.3 cm was disposed between them as anodes with the corresponding electrical connections being made. The cell was filled with an electrolyte solution which contained 0.7 mol/l manganese sulfate and 0.5 mol/l sulfuric acid. A stock vessel contained neutral manganese sulfate solution (pH between 5–7) which could be fed into the electrolysis cell via a dispensing device. A volume of liquid equivalent to this feed was discharged from the cells via an overflow so that the filled volume of the cell remained constant. Since the electrolyte becomes depleted in manganese and enriched in sulfuric acid as a result of the electrolysis, this feed of neutral manganese sulfate solution had the effect that the manganese and sulfuric acid concentrations were kept constant. The feed volume necessary for this purpose was matched to the requirement on the basis of analytical determinations of concentration. It depends on the current consumption of the cell and the desired concentrations. The electrolysis bath was adjusted to a constant temperature of 95° C.

After a current of 7.5 A=0.85 A.dm$^{-2}$ was switched on, a cell voltage of 2.4 V was measured. After an electrolysis period of 10 days, the cell voltage had risen to 3.2 V.

After 10 days the electrolysis was terminated and the anode was removed from the bath. An 8 mm-thick layer of EMD with a smooth surface and a series of fine cracks formed. This form of deposit was good. Only $\epsilon$-$MnO_2$ was found by X-ray photography.

EXAMPLE 2

(Preparation of EMD at higher current density)

The experimental arrangement was the same as in Example 1, but the cell was operated with a current of 10.6 A (≙1.20 A.dm$^{-2}$. At the beginning the cell voltage was 2.6 V and towards the end of the electrolysis it was 3.5 V. The deposit again had a smooth surface, but exhibited in some placed points of disintegration which had been filled up with greasy manganese dioxide. A part of the deposit had detached itself from the electrode base. In addition to $\epsilon$-$MnO_2$, the $\beta$-modification, which is inactive in batteries, was also found by X-ray photography. This deposit was unsatisfactory.

EXAMPLE 3

(Preparation of REMD)

The same basic experimental arrangement was used as in Example 2, but it was additionally possible to pass air through the stock vessel containing the neutral manganese sulfate solution so that the solution contained in it was constantly vigorously agitated. Then, before the beginning of the electrolysis, a certain quantity of sodium hydroxide solution was introduced into the stock vessel. The stock of solution was so dimensioned that it was sufficient to maintain the electrolyte concentration in the cell for an electrolysis lasting 10 days (see Table I below).

In Table I, the quantity of NaOH per cubic meter which was added to the stock solution is specified in the second column. The concentration of hydrated hausmannite nuclei fed in, which form under these conditions, is proportional to this quantity of sodium hydroxide solution.

This series of experiments showed that, at a current density of 1.2 A.dm$^{-2}$, a coherent, imperfection-free and by far predominantly rough deposit had formed even with a rath low nuclei concentration. A fairly high dosaging of nucleating agents also did not result in any way in a poor REMD layer. It is evident that, as the nuclei concentration increases, the specific surface of the REMD becomes smaller. At lower temperatures (90° C.) quite analogous results are produced but the BET surface does not decrease quite so markedly.

EXAMPLE 4

In an electrolysis cell having the dimensions 180 cm long, 120 cm wide and 260 cm deep 11 vertically suspended cathodes of the format 90×230 cm had 10 anodes of the same format between them. The cell was capable of being heated and was supplied with fresh electrolyte from a stock tank containing 3 m$^3$ of manganese sulfate solution. It was also possible to pass air into this stock tank. Manganese sulfate solution removed was replenished by fresh manganese sulfate solution. Furthermore, a certain quantity of sodium hydroxide solution was added regularly. This is specified in the second column of the Table. In this Table, in addition to the usual data, the manganese(IV) concentration, which was determined as a stationary value in the electrolyte of the electrolysis cell by the abovementioned analysis method, is also specified in column 6 (see Table II below).

This example shows that, even with large format cells, REMD substantially covering the surface can be produced in this manner. With varying dosaging, zones of EMD can be interposed in a deposit of REMD, or else a portion of smooth EMD remains intact.

EXAMPLE 5

In a further set of electrolyses, the current density of the electrolysis was varied with an experimental arrangement as in Example 4 (see Table III below):

With a current density of 0.85 A.dm$^{-2}$ and without nucleating agents being added, a smooth glass-like EMD deposit with a few relatively small imperfections and with an REMD form on the lower quarter of the anode, which had extended itself at the sides to half way up, was formed.

After hydrated hausmannite nuclei had been added in accordance with Example 4, a very good deposit of REMD was again obtained, and in fact, up to a current density of 1.5 A.dm$^{-2}$. It was not possible to test higher current densities in the cells of this format. No. 2 in this Table contains, as a comparison, the example of electrolytic manganese dioxide to the electrolysis cell while maintaining a fairly high concentration of EMD particles (equivalent to approx. 200 mg/l $Mn^{+4}$). No more extensive formation of REMD was observed as in No. 1 without EMD being added.

TABLE I

| No. | NaOH expenditure kg · m$^{-3}$ | Current density A · dm$^{-2}$ | $H_2SO_4$ concentration kg · m$^{-3}$ | Temperature °C. | $Mn^{4+}$ concentration g · m$^{-3}$ | BET surface m$^2$ · g$^{-1}$ | State of the surface | Quality of the deposit |
|---|---|---|---|---|---|---|---|---|
| 1 | — | 1.2 | 40–45 | 95 | — | 48 | smooth, with disintegration points, sludge in the latter, cracks | poor |
| 2 | 0.4 | 1.2 | 40–45 | 95 | | 46 | slightly rough, uniform, small smooth regions | good |
| 3 | 0.8 | 1.2 | 40–50 | 95 | | 38 | rough, very uniform | very good |
| 4 | 2.3 | 1.2 | 35–45 | 95 | | 21 | rough, very uniform | very good |
| 5 | 4.6 | 1.2 | 40–45 | 95 | | 16 | rough, very uniform | very good |
| 6 | — | 1.2 | 40–45 | 90 | | 55 | smooth, numerous structural imperfections, exfoliations, sludge formation in cracks | very poor |
| 7 | 0.4 | 1.2 | 40–45 | 90 | | 45 | rough, uniform | very good |
| 8 | 0.8 | 1.2 | 40–45 | 90 | | 39 | rough, uniform | very good |
| 9 | 2.3 | 1.2 | 40–45 | 90 | | 17 | rough, uniform | very good |
| 10 | 4.6 | 1.2 | 40–45 | 90 | | 23 | rough, uniform | very good |

TABLE II

| No. | NaOH expenditure kg · m$^{-3}$ | Current density A · dm$^{-2}$ | $H_2SO_4$ concentration kg · m$^{-3}$ | Temperature °C. | $Mn^{4+}$ concentration g · m$^{-3}$ | BET surface m$^2$ · g$^{-1}$ | State of the surface | Quality of the deposit |
|---|---|---|---|---|---|---|---|---|
| 1 | — | 1.05 | 45–50 | 93 | — | 51 | smooth EMD surface, disintegration points and numerous cracks, lifting of lumps | poor |
| 2* | — | 1.05 | 45–50 | 93 | — | 35 | rough surface, no disintegration points | satisfactory |
| 3 | 2.5 | 1.05 | 45–50 | 95 | 10–15 | 27 | rough, uniform, a few smooth places in between | very good |
| 4 | 2.5 | 1.05 | 45–50 | 93 | 10–15 | 30 | rough, uniform | very good |
| 5 | 0.5–2.5 | 1.05 | 45–50 | 92–93 | 0–15 | 42 | partly rough, partly smooth, some exfoliations | not completely satisfactory |
| 6 | 0.5–3 | 1.05 | 45–47 | 92–93 | 0–17 | u.b. | predominantly rough, a few regions smooth, hardly any cracks | good |

*same electrode as 1, edge region.

TABLE III

| No. | NaOH expenditure* kg · m$^{-3}$ | Current density A · dm$^{-2}$ | $H_2SO_4$ concentration kg · m$^{-3}$ | Temperature °C. | $Mn^{4+}$ concentration g · m$^{-3}$ | BET surface m$^2$ · g$^{-1}$ | State of the surface | Quality of the deposit |
|---|---|---|---|---|---|---|---|---|
| 1 | — | 0.85 | 40 | 95 | — | 52 | smooth, rough in edge zones (some exfoliations on approx. 25% of the surface) | satisfactory |
| 2 | — | 0.85 | 30–40 | 94 | 200** | 48 | smooth, rough in edge zones, some exfoliations as under 1 | satisfactory |
| 3 | 2.5 | 0.85 | 35 | 95 | 30 | 23 | rough, uniform, no lifting of any kind | very good |
| 4 | 2.5 | 1.1 | 30–40 | 95 | 45 | 15 | rough, uniform, no cracks or lifting of any kind | very good |
| 5 | 2.5 | 1.3 | 35 | 95 | 30 | 18 | rough, uniform, few regions smooth and glass-like in fracture | good |
| 6 | 2.5 | 1.5 | 35 | 95 | 20–120 | 23 | rough, uniform, imperfection-free | very good |

*quantity of NaOH added per cubic meter of fresh solution fed into the cell
**by feeding in very finely divided electrolytic manganese dioxide (diam. <30 μm, mean diam. approx. 15 μm)

We claim:

1. In the process for the preparation of electrolytic manganese dioxide (EMD) by electrolyzing an electrolyte consisting of a sulfuric acid solution of manganese sulfate by means of titanium anodes the steps comprising the manganese sulfate and sulfuric acid concentrations in the said solution are kept constant by continuously removing a part by volume of the used electrolyte replacing the removed electrolyte by supplying an equivalent volume of fresh manganese sulfate solution, producing flocculent nuclei of a manganese oxide hydrate in said manganese sulfate solution and supplying these nuclei together with the manganese sulfate solution to the electrolyte in the cell.

2. The process as claimed in claim 1, wherein, to produce the nuclei, sodium hydroxide solution is added to the manganese sulfate solution to produce a pH value of at least 7.8.

3. The process as claimed in claim 2 wherein oxygen or air is introduced into the manganese sulfate solution simultaneously with the addition of sodium hydroxide solution or subsequently thereto.

4. The process as claimed in claim 1, wherein flocculent nuclei of manganese dioxide hydrate are produced only in a part of the manganese sulfate solution, which is fed to the cell to keep the manganese concentration constant, by tapping off from the manganese sulfate solution a partial flow containing a quantity of manganese sulfate such as is required for flocculation, then adjusting the pH to 11.5–12.5 with sodium hydroxide solution, and passing air through before the suspension of flocculent nuclei produced is again added to the manganese sulfate solution.

5. The process as claimed in claim 1, wherein sodium hypochlorite is added to the manganese sulfate solution in sufficient quantities to form $MnO_x.nH_2O$, where $x=1.8–1.9$ and $n=<1$.

6. The process as claimed in claim 1, wherein sodium hydroxide solution and hydrogen peroxide are added to the manganese sulfate solution in sufficient quantities to form $MnO_x.nH_2O$, where $x=1.8–1.9$ and $n=<1$.

7. The process as claimed in claim 1, wherein the manganese sulfate solution which contains the manganese oxide hydrate nuclei is supplied to the electrolyte in the cell in a quantity such that a nuclei concentration of 10–200 mg/l is established in the electrolyte.

8. The process as claimed in claim 7, wherein the manganese sulfate solution is supplied to the electrolyte in a quantity such that a nuclei concentration of 30–60 mg/l is established in the electrolyte.

* * * * *